United States Patent [19]

Anthony

[11] Patent Number: 4,560,171

[45] Date of Patent: Dec. 24, 1985

[54] POKER GAME

[76] Inventor: Zacharias Anthony, 181 Atlantic Ave., Long Branch, N.J. 07740

[21] Appl. No.: 635,703

[22] Filed: Jul. 30, 1984

[51] Int. Cl.[4] ..... A63F 3/00

[52] U.S. Cl. ..... 273/269

[58] Field of Search ..... 273/144 R, 144 A, 144 B, 273/269, 270

[56] References Cited

U.S. PATENT DOCUMENTS

| | | | |
|---|---|---|---|
| 1,723,377 | 8/1929 | Salomon | 273/269 |
| 2,355,785 | 8/1944 | Dorfman | 273/269 X |
| 3,618,952 | 11/1971 | Tallarida | 273/269 |
| 3,690,668 | 9/1972 | Weeks | 273/269 X |
| 4,364,567 | 12/1982 | Goott | 273/144 B X |

FOREIGN PATENT DOCUMENTS

| | | | |
|---|---|---|---|
| 1172231 | 11/1969 | United Kingdom | 273/269 |
| 1503114 | 3/1978 | United Kingdom | 273/269 |

*Primary Examiner*—Harland S. Skogquist

[57] ABSTRACT

A poker game is disclosed which includes several gameboards. Each of the gameboards includes at least 52 locations, or more if the use of jokers is desired. Each of the locations displays therein a symbol of a different playing card from a standard deck of cards. Each of the locations also displays therein one of a series of at least 52 sequential numbers, which are independent of and unrelated to the playing card symbols. Either the playing card symbols or the numbers are randomly arranged on each gameboard. Each of the gameboards thus has different combinations of playing card symbols and indicia within its locations. A "wheel of fortune" is provided for randomly generating a series of numbers corresponding to the numbers on the gameboards. Upon operation of the wheel of fortune, each gameboard has associated therewith a poker hand consisting of the playing cards symbolized in the locations corresponding to the series of numbers thus generated.

25 Claims, 7 Drawing Figures

20

| | | | | | |
|---|---|---|---|---|---|
| JOKER 53 | 10 ♠ 1 | 5 ♠ 2 | 4 ♣ 3 | 5 ♦ 4 | J ♦ 5 |
| | 3 ♦ 6 | 7 ♣ 7 | 2 ♥ 8 | Q ♠ 9 | 6 ♠ 10 |
| 8 ♥ 11 | 4 ♥ 12 | 9 ♠ 13 | 9 ♥ 14 | 6 ♦ 15 | 2 ♠ 16 |
| 10 ♣ 17 | 2 ♣ 18 | A ♠ 19 | 8 ♣ 20 | J ♠ 21 | K ♥ 22 |
| A ♥ 23 | 7 ♥ 24 | 8 ♠ 25 | 6 ♣ 26 | J ♣ 27 | 9 ♣ 28 |
| 7 ♦ 29 | A ♦ 30 | 8 ♦ 31 | K ♦ 32 | 7 ♠ 33 | 3 ♠ 34 |
| K ♠ 35 | 2 ♦ 36 | 4 ♦ 37 | Q ♣ 38 | 10 ♥ 39 | Q ♦ 40 |
| 9 ♦ 41 | 6 ♥ 42 | 3 ♥ 43 | 5 ♣ 44 | K ♣ 45 | 4 ♠ 46 |
| 10 ♦ 47 | 3 ♣ 48 | J ♥ 49 | A ♣ 50 | Q ♥ 51 | 5 ♥ 52 |

FIG. 2

30

| | | | | | |
|---|---|---|---|---|---|
| JOKER 53 | 6 ♣ 1 | 10 ♠ 2 | A ♣ 3 | Q ♣ 4 | 2 ♥ 5 |
| | A ♠ 6 | J ♠ 7 | Q ♥ 8 | 7 ♥ 9 | 3 ♦ 10 |
| 7 ♣ 11 | 9 ♥ 12 | K ♦ 13 | 6 ♦ 14 | 3 ♠ 15 | K ♣ 16 |
| 8 ♣ 17 | 4 ♠ 18 | 9 ♣ 19 | 8 ♦ 20 | 9 ♠ 21 | J ♦ 22 |
| K ♠ 23 | 3 ♣ 24 | Q ♠ 25 | 10 ♥ 26 | 2 ♦ 27 | Q ♦ 38 |
| 9 ♦ 29 | 5 ♥ 30 | 4 ♥ 31 | 6 ♥ 32 | J ♣ 33 | 7 ♦ 34 |
| 10 ♦ 35 | J ♥ 36 | 8 ♠ 37 | 2 ♣ 38 | 2 ♠ 39 | 8 ♥ 40 |
| A ♦ 41 | 4 ♣ 42 | 3 ♥ 43 | 4 ♦ 44 | 10 ♣ 45 | 5 ♣ 48 |
| 5 ♠ 47 | 6 ♠ 48 | 5 ♦ 49 | K ♥ 50 | A ♥ 51 | 7 ♠ 52 |

FIG. 3

| | | | | | | | | | | | | | |
|---|---|---|---|---|---|---|---|---|---|---|---|---|---|
| A♠ 13 | K♠ 35 | Q♠ 15 | J♠ 10 | 10♠ 48 | 9♠ 1 | 8♠ 12 | 7♠ 19 | 6♠ 51 | 5♠ 37 | 4♠ 43 | 3♠ 2 | 2♠ 4 |
| A♥ 23 | K♥ 8 | Q♥ 25 | J♥ 14 | 10♥ 26 | 9♥ 7 | 8♥ 3 | 7♥ 47 | 6♥ 30 | 5♥ 45 | 4♥ 49 | 3♥ 39 | 2♥ 6 |
| A♣ 20 | K♣ 52 | Q♣ 33 | J♣ 27 | 10♣ 18 | 9♣ 31 | 8♣ 21 | 7♣ 22 | 6♣ 16 | 5♣ 32 | 4♣ 24 | 3♣ 40 | 2♣ 17 |
| A♦ 36 | K♦ 11 | Q♦ 50 | J♦ 41 | 10♦ 5 | 9♦ 28 | 8♦ 34 | 7♦ 29 | 6♦ 44 | 5♦ 38 | 4♦ 9 | 3♦ 46 | 2♦ 42 |

FIG. 6

| | | | | | | | | | | | | | |
|---|---|---|---|---|---|---|---|---|---|---|---|---|---|
| A♠ 22 | K♠ 19 | Q♠ 34 | J♠ 49 | 10♠ 27 | 9♠ 32 | 8♠ 21 | 7♠ 36 | 6♠ 46 | 5♠ 44 | 4♠ 41 | 3♠ 12 | 2♠ 42 |
| A♥ 11 | K♥ 26 | Q♥ 13 | J♥ 33 | 10♥ 48 | 9♥ 17 | 8♥ 15 | 7♥ 24 | 6♥ 7 | 5♥ 45 | 4♥ 18 | 3♥ 52 | 2♥ 14 |
| A♣ 4 | K♣ 51 | Q♣ 25 | J♣ 31 | 10♣ 30 | 9♣ 28 | 8♣ 9 | 7♣ 10 | 6♣ 5 | 5♣ 1 | 4♣ 8 | 3♣ 2 | 2♣ 6 |
| A♦ 39 | K♦ 20 | Q♦ 23 | J♦ 35 | 10♦ 29 | 9♦ 38 | 8♦ 50 | 7♦ 43 | 6♦ 16 | 5♦ 47 | 4♦ 40 | 3♦ 3 | 2♦ 37 |

FIG. 7

POKER GAME

FIELD OF THE INVENTION

The present invention relates to a poker game, and in particular to a poker game which may be played by a large number of players with specially designed playing boards and without the need for a conventional deck of playing cards.

BACKGROUND OF THE INVENTION

It is difficult to overstate the allure and the fascination which the game of poker has had over its long history. Although the game of poker is almost universally known, it will be helpful to describe the basic rules. In particular, a standard deck of playing cards consists of at least 52 cards, divided into four "suits", namely spades, hearts, diamonds and clubs, each suit having thirteen cards of varying denominations. Within each suit there is an ace, a king, a queen, a jack, and each number between two and ten, with the ace functioning as a "low card" having a numerical value of one, and also being available to function as a "high" card with a higher ranking than a king.

Although numerous variations of poker exist, virtually every variation includes placing at least five cards in the possession of each player. The cards form a "hand" under well-established rules. A player may have a single "pair" of cards of a given denomination (e.g., two jacks), or three of a kind (e.g., three fives) or four of a kind (e.g., four tens). It is also possible to have two different pairs (e.g., two queens and two eights). Another hand includes both three of a kind and a different pair (e.g., three tens and two fours), which is known as a "full house". Still another possible hand consists of five cards of the same suit (e.g., five cards from the "hearts" suit) which is called a "flush". It is also possible to have a run of consecutive cards (such as 8-9-10-Jack-Queen) which is called a "straight". When the cards of a straight are all of the same suit, an even higher ranking hand is generated, namely a "straight flush". The various hands have relative rankings according to well-defined rules. In a typical game of poker, the highest ranking hand wins, although well-known and popular variations exist in which rewards are available to the lowest ranking hand.

Numerous variations of poker have developed which add excitement to the game. One or more cards may be dealt "down" so that the identity thereof is known only to the player, with other cards placed visibly on the playing surface for the opposing players to see and evaluate. Another popular variation is "draw" poker, in which each player may discard some of his cards and replace them with new cards. Still another variation includes providing each player with more than five cards (e.g., seven card stud), which allows a player to select his or her most advantageous five card hand from the seven.

As a further variable, poker is sometimes played with one or more "wild" cards, which may be any card agreed upon by the players in advance, and which may be designated by the player who receives it to be any card in the deck. Wild cards provide each player with enormous flexibility and tend to promote higher ranking hands and, consequently, more excitement. In many instances, one or more "jokers" is added to the standard deck of 52 playing cards to function as wild cards.

Although poker has been and remains endlessly fascinating to many players, it obviously has its drawbacks. For one thing, with a single deck of standard playing cards, there is a limit to the number of persons who may play at one given time. When playing a variation of poker in which each player utilizes only five cards, no more than 10 persons can play at any one time. When playing "draw" poker in which each player may use as many as eight cards in a given hand, there can be no more than six players at once.

As a further matter, in order to play a conventional game of poker, it is necessary to have a deck of playing cards which is both complete and in good condition. If even one card is lost, a proper game of poker cannot be played. If one or more cards gets bent or otherwise harmed, the play of the game may be severely impaired, since it may become possible to improperly identify a playing card from its reverse side.

As a further matter, the game of poker can in some instances become quite boring. There are few if any variables to the game, such as lucky numbers or letters, other than the random dealing of the cards. Moreover, it is impossible for more than one player to receive the benefit of a given card. Thus, for example, if one player knows that he has three aces, he also knows that at most one other player has one ace and all the other players have no aces at all. In some circumstancess, this can limit the excitement and intrigue of the game.

Over the years, games have been developed which attempt to capture the excitement and intrigue of poker, but which themselves have had serious limitations. Thus, in U.S. Pat. No. 1,723,377 in the name of Irving Salomon, there is provided a poker game in which each player is provided with a board having five rows and five columns for a total of twenty-five locations, with the representation of one playing card appearing in each location. In the Salomon game, the playing boards themselves each already have relatively desirable poker hands in each of the horizontal rows and in some of the vertical columns. The play of the game requires a conventional deck of playing cards. To play Salomon's game, one card at a time is turned over from the deck of playing cards. Since each player's board only has twenty-five cards, there is less than a fifty-fifty chance that any player will have the overturned card on his playing board. If the player has the overturned card on his board, he places a marker thereon. The play continues with more cards from the deck being overturned. It can be readily appreciated that, at different stages of the game, some players will have more cards in their hands than other players. Indeed, it is possible to play Salomon's game with one player achieving a complete poker hand, while other players are totally left out and have no cards at all in their hands. The players who do not even add cards to their hands are quite obviously left out of the excitement, since it is impossible to develop a competitive hand when a player does not have a hand at all.

Other attempts have been made to utilize playing cards to create a new type of game. For example, British Pat. No. 1,172,231 in the name of Frederick J. Mortimer discloses a game in which each player is given a board having various representations of playing cards thereon. However, in the Mortimer game the boards are arranged by suit and in descending order of denomination, and only a few denominations from each suit are provided. A deck of playing cards is utilized with one card being turned over at a time, and the game which is played is not poker, but bingo. Other prior art games, such as U.S. Pat. No. 3,618,952 in the name of Ronald J. Tallarida, likewise utilizes representations of playing cards, but is simply not a poker game.

Accordingly, it is the object of the present invention to provide a new, different and exciting poker game.

It is a further object of the present invention to provide such a poker game in which more persons may play at the same time than is the case with conventional poker.

It is another object of the present invention to provide such a poker game in which no conventional deck of playing cards is necessary for the game to be played.

It is yet a further object of the present invention to provide such a poker game in which each player always has the same number of cards as the play progresses.

It is still another object of the present invention to provide such a poker game in which each playing board provides each player with a random but equal opportunity to succeed, as well as an opportunity to achieve any and every different poker hand in a given game.

It is still an additional object of the present invention to provide such a poker game having a variable other than the cards themselves, such as numbers or letters.

It is yet another object of the present invention to provide such a poker game in which it is possible for more than one player to have the benefit of particular cards in a given hand.

These and various other objects and advantages of the present invention will become clear from the following detailed description of an exemplary embodiment thereof, and the novel features will be particularly pointed out in conjunction with the claims appended hereto.

SUMMARY OF THE INVENTION

In accordance with the teachings of the present invention, a poker game includes a plurality of gameboards. Each of the gameboards includes at least 52 locations. Each of the locations displays therein a symbol of a different playing card from a standard deck of cards. Each of the locations further displays therein one of a series of at least 52 sequential indicia. The indicia are independent of and unrelated to the playing card symbols. The playing card symbols or the sequential indicia are randomly arranged on each gameboard. Each of the gameboards has different combinations of playing card symbols and indicia within its locations. Means are provided for randomly generating a series of indicia corresponding to the sequential indicia on the gameboards. Upon operation of the generating means, each gameboard has associated therewith a poker hand consisting of the playing cards symbolized in the locations corresponding to the series of indicia thus generated. The invention will be more fully understood by reference to the following detailed description of an exemplary embodiment thereof in conjunction with the accompanying drawings in which:

FIG. 2 is a plan view of an additional, different representative gameboard of the first embodiment of the present invention;

FIG. 3 is a plan view of an additional, different representative gameboard of the first embodiment of the present invention;

FIG. 6 is a plan view of an additional, different representative gameboard of the second embodiment of the present invention; and FIG. 7 is a plan view of an additional, different representative gameboard of the second embodiment of the present invention.

DESCRIPTION OF THE PREFERRED EMBODIMENT

Figure 1:
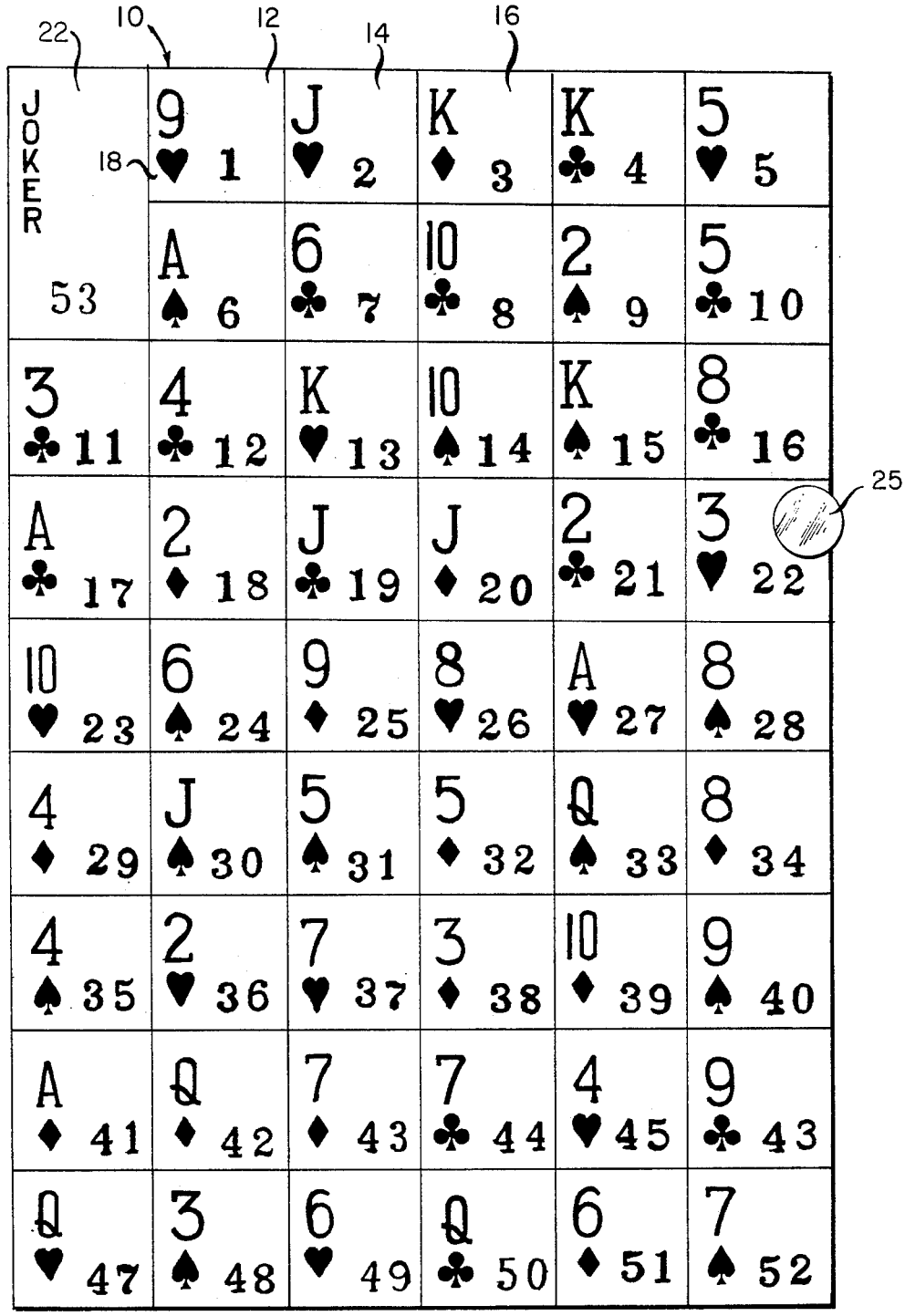
FIG. 1 is a plan view of a representative gameboard of a first embodiment of the present invention.

Referring now to the drawings, wherein like reference numerals designate like parts throughout the several views, and more particularly to FIG. 1, there is shown a representative gameboard 10 of the type to be utilized in the present invention. The gameboard 10 may be made from any appropriate material, such as cardboard, paper or plastic. They may be any convenient size and shape.

As can readily be seen from FIG. 1, the gameboard 10 has a total of 53 numbered locations. In the particular configuration shown in FIG. 1, the gameboard location indicated by reference numeral 12 has the index number 1; location 14 has the index number 2; location 16 has the index number 3, and so forth. The numbered locations are arranged in conventional sequence, i.e., moving from left to right and then down to the following row and again left to right, and so forth. It will be seen from a comparison of FIG. 1 with FIGS. 2 and 3 that this arrangement is preferably the same for all of the gameboards in a given poker game.

It will then be appreciated that location 12, bearing the index number 1, has upon it a symbol of the nine of hearts, indicated by reference numeral 18. In like fashion, each location on the gameboard 10 having an index number also has a symbol of a different playing card from a standard deck of cards. Thus, in gameboard 10, in the numbered locations 1 through 52, there is only one nine of hearts, which appears in the location having index number 1; one jack of hearts which appears in the location having index number 2; one king of diamonds which appears in the location having index number 3; and so forth. It should also be appreciated that within the locations having index numbers 1 through 52, the symbols of the different playing cards are arranged at random. Thus, by comparing the gameboard 10 in FIG. 1 with gameboard 20 in FIG. 2 or gameboard 30 in FIG. 3, it will be appreciated that a symbol of a different playing card can and ordinarily will appear in each different numbered location. Thus, while the location having index number 1 in gameboard 10 has the nine of hearts, the location having index number 1 in gameboard 20 has a symbol of the ten of spades, while in gameboard 30 shown in FIG. 3 there is a six of clubs. It can thus be appreciated that, except for the occasional possibility of the same playing card appearing in the same numbered location, for the most part, any given index number will correspond to a different playing card for each different player having a different gameboard 10, 20, 30, etc.

The gameboard 10 shown in FIG. 1 not only has locations with index numbers 1 through 52, but also includes a location with index number 53 in the upper left-hand corner, designated by reference numeral 22. In the location bearing index number 53 there is a symbol of a joker. Thus, in the embodiment of the invention presently being discussed, there are a total of 53 locations bearing the sequential numbers 1 through 53, each of the locations having either a symbol of a standard playing card or a symbol of a joker. It will be noted that gameboard 20 shown in FIG. 2 also has a joker in location number 53, as does gameboard 30 shown in FIG. 3.

With regard to the use of a joker, several considerations must be kept in mind. First, the present invention can be readily used without a joker. The gameboards 10, 20, 30, etc., can be designed to have no symbol of a joker whatsoever, and to simply have 52 numbered locations, each having a symbol of a standard playing card. As an additional matter, the gameboards illustrated in FIGS. 1, 2 and 3 can still be utilized to play a poker game without a joker. It would be possible to use a generating means (to be discussed below) which only has 52 numbers, rather than 53. Alternatively, if a generating means has 53 or more numbers, it can be determined in advance that the numbers above 52 will simply have no affect on the game and will be ignored. Similarly, two or more jokers can be utilized, with the sequential numbers running up to 54 or higher as needed.

Additionally, with the arrangement shown in FIGS. 1, 2 and 3, the joker corresponds to the same numbered location on each gameboard. Thus, if the only three players were those having the gameboards 10, 20 and 30 shown in FIGS. 1, 2 and 3 respectively, if any one player has a joker in any given hand, so will all the other players. However, it should be appreciated that the joker need not be in the same numbered location for all the gameboards, but can be located randomly like any other card, so that one player might have a joker in a given hand, while the other may not.

It should also be noted that while index numbers 1 through 53 have been illustrated, any sequential indicia could be used, such as a different sequence of numbers, or letters of an alphabet (doubled or tripled as needed, i.e., A, B, . . . Z, AA, BB, . . . ZZ, etc.). Moreover, while the drawings show actual pictures of playing card denominations and suits, the symbols could be any appropriate designation (e.g., "seven of spades" or "7S").

Figure 4:
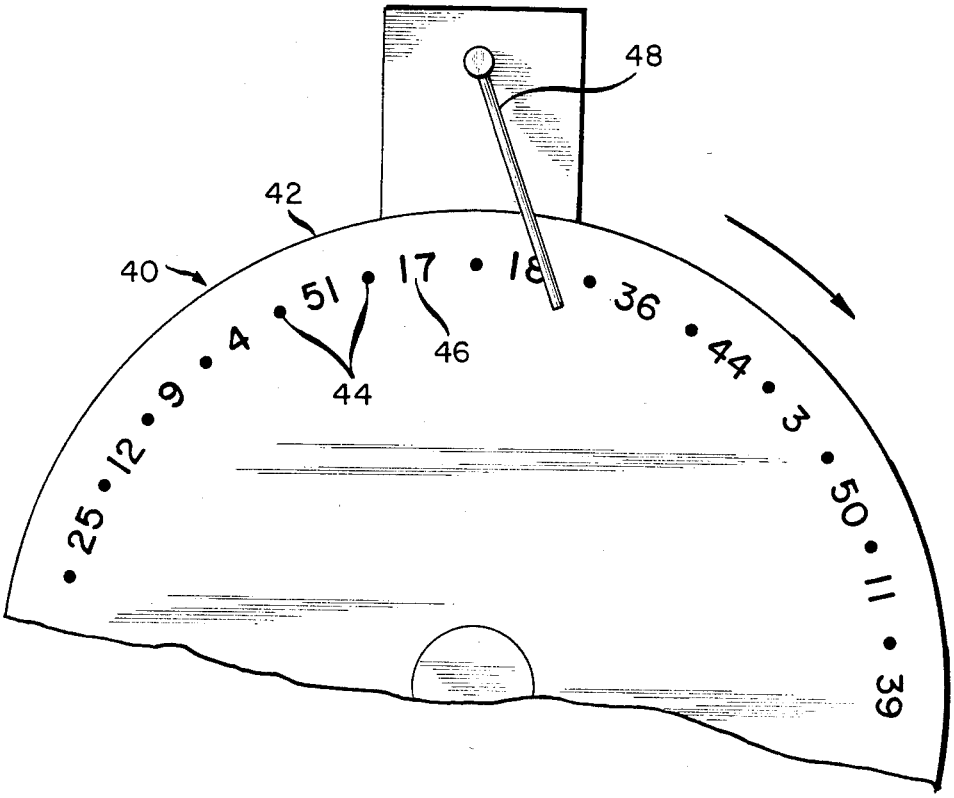
FIG. 4 is an elevation view of a generating means of the present invention of the "wheel-of-fortune" type.

Turning now to FIG. 4, there is shown a device for generating a series of numbers corresponding to the sequential numbers appearing on the gameboards 10, 20, 30, etc. In particular, there is a wheel-of-fortune device 40, which is of the type conventionally known and used for various games of chance, having a generally circular wheel 42 and a series of spikes 44 spaced evenly about the perimeter of the wheel 42. Within the space defined by the spikes 42 is a number 46 which should correspond to the numbers 1 through 52 for a poker game of the present invention involving no jokers, or 1 through 53 for such a poker game involving one joker, or 1 through 54 for a poker game involving two jokers. An indicator wand 48 is situated at the top of the device 40 and extending downwardly so that it may flap between the spikes 44 as the wheel 42 spins. When the wheel 42 comes to rest after having been rotated, the wand 48 will come to rest between a particular pair of spikes 44 and thus indicate a numeral 46. It wil be appreciated that any other advice for generating numbers could be utilized, such as a "spinner" or a roulette-type wheel.

With the apparatus of the present invention having thus been described, the play of the game can now be discussed. For the sake of simplicity, it will be assumed that there are only three players, one having the gameboard 10 shown in FIG. 1, one having the gameboard 20 shown in FIG. 2, and one having the gameboard 30 shown in FIG. 3, although it will be appreciated that a much larger number of gameboards can be utilized. It will then be assumed that the game to be played is simple five card poker, which requires only that the wheel-of-fortune device 40 be spun five times. (If the same number happens to be spun two or more times during the play of a single hand, as is obviously possible, the second and subsequent such occurrences would simply be ignored and play would then just proceed.)

Let us assume that the five numbers thus spun are 19, 10, 42, 30 and 6. In such event, the player holding gameboard 10 would, in that order, have the jack of clubs, the five of clubs, the queen of diamonds, the jack of spades and the ace of spades. His hand would thus be a pair of jacks. The player having gameboard 20 shown in FIG. 2, with the same five numbers having been called, would have the ace of spades, the six of spades, the six of hearts, the ace of diamonds and the three of diamonds. This corresponds to a hand consisting of two pairs, aces and sixes. Finally, the player holding gameboard 30 in FIG. 3 would have the nine of clubs, the three of diamonds, the four of clubs, the five of hearts and the ace of spades. This hand consists only of ace high, so that the winner would be the player holding gameboard 20 shown in FIG. 2, with the best hand. It should be noted that, in the hands just described, each player had an ace of spades, an occurrence which would not be possible in standard poker.

The importance of a joker can be highlighted by proposing that, in the hands just described, instead of the first number having been 19, assume that instead it was 53, so that each player had the benefit of a wild card. In that event, the player holding gameboard 10 shown in FIG. 1 would then utilize the joker and be able to have a pair of aces. The player holding gameboard 20 could utilize the joker to then have three sixes. The player having gameboard 30 shown in FIG. 3, however, would then have a straight from the ace to the five, and would thus be the winner of that hand.

As a variation and as a further aspect of the present invention, the poker game may be played in the following way. Before any numbers are generated, a particular poker hand is pre-selected (e.g., a full house). The numbers are generated and play proceeds until at least one player has the pre-selected hand. This might well occur after five, seven or even more numbers are generated, particularly where a difficult hand (such as a straight flush) is pre-selected. Such a variation could be particularly suspenseful. For example, with a full house as the pre-selected hand, after five numbers are generated, one player might have two pairs and thus be on the verge of winning, while another player might have a poor hand. While the first player waits for the one card he needs, the second player might catch up and might even be the first to achieve the pre-selected hand.

With regard to the actual play of the game, each player should be provided with an appropriate number of markers, tokens or chips 25 so that his or her gameboard can be temporarily marked to show the development of the hand. If five card poker is played, each player will need five such markers; if seven card stud is played, then seven such markers will be needed by each player; and so forth. Means should also be provided (not shown) for recording the numbers of each hand as they are called (e.g., a handwritten list), so that each player's hand can be verified at the end of each game, to avoid the possibility of a player making an error or incorrectly claiming to have a hand which in fact he or she does not have.

With regard to the device for generating the numbers, although a wheel-of-fortune type device has been described, it will be readily appreciated that any other device for randomly generating a number between 1 and 52 (or 1 and 53 or 54, depending upon the use of jokers) can be used. A conventional random number generator, utilizing a computer or any other technique, can readily be employed advantageously with the present invention. If a computer is utilized, it should preferably be programmed to immediately skip over any numbers which are repeats of numbers already chosen within a given hand.

Figure 5:
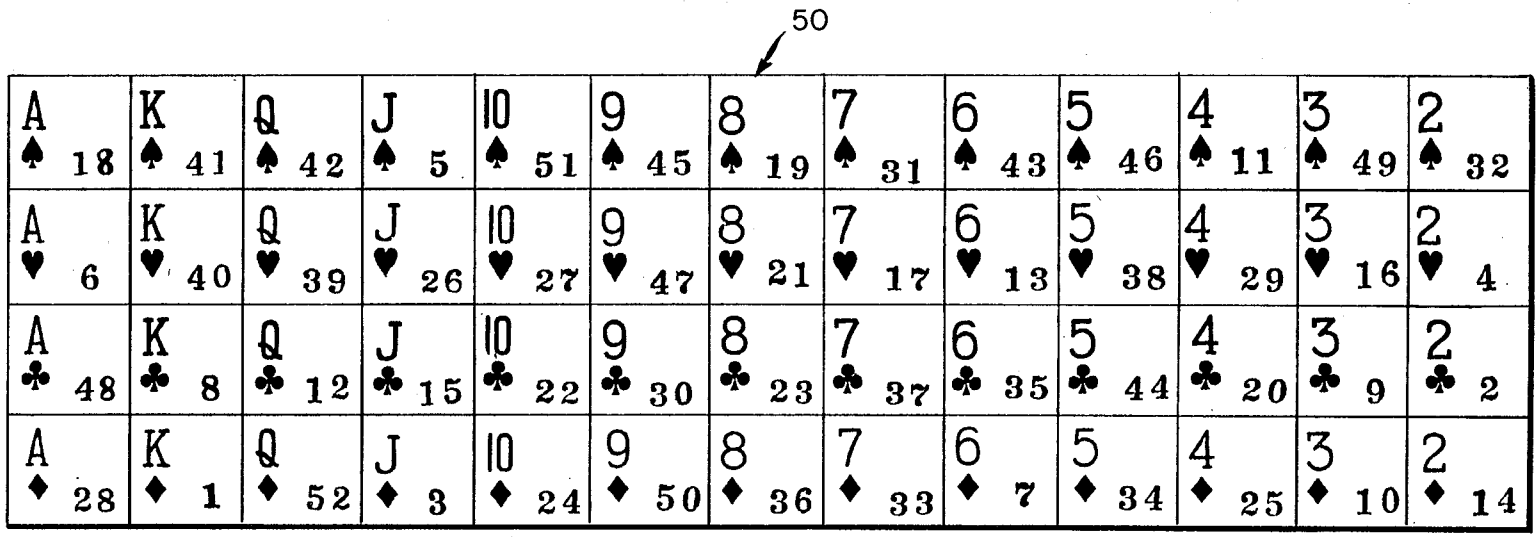
FIG. 5 is a plan view of a representative gameboard of a second embodiment of the present invention.

FIGS. 5, 6 and 7 illustrate a different embodiment of the gameboards of the present invention. Referring, for example, to gameboard 50 shown in FIG. 5, it will be seen that the gameboard 50 is arranged so that the playing card symbols appear in a conventional sequence (i.e., by suit and in order of denomination), while the numbers 1 through 52 are not arranged in a continuous sequence, but are randomly positioned about the 52 locations on the gameboard. It will be readily appreciated that this alternative embodiment poses both advantages and disadvantages as compared with the embodiment already described. With the embodiment of the gameboards shown in FIGS. 5, 6 and 7, when a number is called out as having been generated by the wheel-of-fortune or other generating means, it is necessary for the player to scan his card until the number is located. This will normally take time, and might slow down the play of the game. On the other hand, this can lead to suspense, particularly as the play of the hand is ending, and each player may have in mind the need for a certain category of card to fill out a hand (e.g., to complete a straight or flush). As an advantage, it will be noted that once a hand is played and markers have been placed upon each card that has been "drawn", it is easier to scan the entire gameboard of this alternative embodiment and make a quick determination as to what the hand is worth, since it will be particularly easy to determine whether there are two, three or four of a kind, or a straight or a flush.

Although the gameboards 10, 20, 30, 50, etc., will normally be "permanent", it will be appreciated that the gameboards can also be moveable or temporary, so that different arrangements of playing card symbols or index numbers can be provided with the same physical "board". Indeed, the gameboard need not be an integral "board" at all but can also be a collection of 52 or more board segments.

As will be readily apparent to those skilled in the art, the invention may be used in some other specific forms of poker game without departing from its spirit or essential characteristics. The present embodiments are, therefore, to be considered as illustrative and not restrictive, the scope of the invention being indicated by the claims rather than the foregoing description, and all changes which come within the meaning or range of equivalents of the claims are therefore intended to be embraced therein.

What is claimed is:

1. A poker game comprising:

a plurality of gameboards, each of said gameboards including at least 52 locations, each of said locations displaying therein a symbol of a different playing card from a standard deck of cards, each of said locations further displaying therein one of a series of at least 52 sequential indicia, said indicia being independent of and unrelated to said playing card symbols, said playing card symbols or said sequential indicia being randomly arranged on each gameboard, each of said gameboards having different combinations of playing card symbols and indicia within its locations; and means for randomly generating a series of indicia corresponding to said sequential indicia, whereby upon operation of the said generating means, each of said gameboards has associated therewith a poker hand consisting of the playing cards symbolized in the locations corresponding to the series of indicia thus generated.

2. A poker game according to claim 1 wherein said playing card symbols are randomly arranged and said sequential indicia appear on said gameboards substantially in conventional sequence.

3. A poker game according to claim 1 wherein said sequential indicia are randomly arranged and said playing card symbols appear on said gameboards substantially in conventional sequence.

4. A poker game comprising:

a plurality of gameboards, each of said gameboards including at least 52 locations having sequential indicia, each of said locations including a symbol of a different playing card from a standard deck of cards, said symbols being randomly arranged on each card so that a representation of each playing card appears in one of said locations, each of said gameboards having a different arrangement of playing card symbols within its locations; and means for randomly generating a series of indicia corresponding to said sequential indicia, whereby upon operation of the said generating means, each gameboard has associated therewith a poker hand consisting of the playing cards symbolized in the locations corresponding to the series of indicia thus generated.

5. A poker game according to claim 4 wherein said sequential indicia consists of consecutive numbers.

6. A poker game according to claim 4 wherein said sequential indicia consists of consecutive letters of an alphabet.

7. A poker game according to claim 4 further comprising means for marking individual ones of said locations when the indicia within said locations have been generated whereby all playing card symbols in said poker hand are concurrently identifiable.

8. A poker game according to claim 4 wherein each gameboard further comprises at least one additional location including a symbol of a wild card.

9. A poker game according to claim 8 wherein said wild card symbol on each of said gameboards appears in the same location on each of said gameboards.

10. A poker game according to claim 8 wherein said wild card symbol appears in different locations on at least two of said gameboards.

11. A poker game comprising:

a plurality of gameboards, each of said gameboards including an array of symbols of different playing cards from a standard deck of cards, said symbols arranged by suit and denomination with a symbol of each playing card appearing one time on each gameboard, thus defining a location associated with each playing card, and sequential indicia randomly arranged on each gameboard so that one of said indicia appears in each of said locations, each of said gameboards having a different arrangement of indicia within its locations; and means for randomly generating a series of indicia corresponding to said sequential indicia, whereby upon operation of the said generating means, each gameboard has associated therewith a poker hand consisting of the playing cards symbolized in the locations corresponding to the series of indicia thus generated.

12. A poker game according to claim 11 wherein said sequential indicia consist of consecutive numbers.

13. A poker game according to claim 11 wherein said sequential indicia consist of consecutive letters of an alphabet.

14. A poker game according to claim 11 further comprising means for marking individual ones of said locations when the indicia within said locations have been generated whereby all playing card symbols in said poker hand are concurrently identifiable.

15. A poker game according to claim 11 wherein each gameboard further comprises at least one additional location including a symbol of a wild card.

16. A poker game according to claim 15 wherein said wild card symbol on each of said gameboards has in its location the same one of said indicia.

17. A poker game according to claim 15 wherein said wild card symbol has associated therewith a different one of said indicia on at least two of said gameboards.

18. A poker game comprising a plurality of gameboards each of said gameboards including at least 52 locations, each of said locations displaying therein a symbol of a different playing card from a standard deck of cards, each of said locations further displaying therein one of a series of at least 52 sequential indicia, said indicia being independent of and unrelated to said playing card symbols, said playing card symbols or said sequential indicia being randomly arranged on each gameboard, each of said gameboards having different combinations of playing card symbols and indicia within its locations, whereby upon generation of a series of indicia corresponding to said sequential indicia, each of said gameboards has associated therewith a poker hand consisting of the playing cards symbolized in the locations corresponding to the series of indicia thus generated.

19. A poker game according to claim 18 wherein said playing card symbols are randomly arranged and said sequential indicia appear on said gameboards substantially in conventional sequence.

20. A poker game according to claim 18 wherein said sequential indicia are randomly arranged and said playing card symbols appear on said gameboards substantially in conventional sequence.

21. A poker game comprising:

a plurality of gameboards, each of said gameboards including a number of locations substantially corresponding to the number of cards in a deck of playing cards, each of said locations displaying therein a symbol of a different playing card from a standard deck of cards, each of said locations further displaying therein one of a series of sequential indicia, said indicia being independent of and unrelated to said playing card symbols, said playing card symbols or said sequential indicia being randomly arranged on each gameboard, each of said gameboards having different combinations of playing card symbols and indicia within its locations; and means for randomly generating a series of indicia corresponding to said sequential indicia, whereby upon operation of the said generating means, each of said gameboards has associated therewith a poker hand consisting of the playing cards symbolized in the locations corresponding to the series of indicia thus generated.

22. A method of play in a poker game comprising:

providing a plurality of gameboards, each of said gameboard including at least 52 locations, each of said locations displaying therein a symbol of a different playing card from a standard deck of cards, each of said locations further displaying therein one of a series of at least 52 sequential indicia, said indicia being independent of and unrelated to said playing card symbols, said playing card symbols or said sequential indicia being randomly arranged on each gameboard, each of said gameboards having different combinations of playing card symbols and indicia within its locations; and randomly generating a series of indicia corresponding to said sequential indicia, whereby each of said gameboards has associated therewith a poker hand consisting of the playing cards symbolized in the locations corresponding to the series of indicia thus generated.

23. A method according to claim 22 wherein a total of five indicia are generated and whereby the poker hand associated with each gameboard consists of the five cards corresponding to said five indicia.

24. A method according to claim 22 wherein more than five indicia are generated and wherein the poker hand associated with each gameboard is formulated by selecting five cards corresponding to five of the indicia thus generated.

25. A method according to claim 22 further comprising the step of pre-selecting a specific poker hand as the game objective prior to said random generation step, and wherein said indicia are generated until at least one gameboard has associated therewith said pre-selected game objective.

* * * * *